US006517413B1

(12) United States Patent
Hu et al.

(10) Patent No.: US 6,517,413 B1
(45) Date of Patent: Feb. 11, 2003

(54) METHOD FOR A COPPER CMP ENDPOINT DETECTION SYSTEM

(75) Inventors: Tien-Chen Hu, Ping-tung (TW); Jin-Churng Twu, Chung-Ho (TW); Chen-Fa Lu, Kaohsiung (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 47 days.

(21) Appl. No.: 09/695,651

(22) Filed: Oct. 25, 2000

(51) Int. Cl.[7] ..... B24B 49/12

(52) U.S. Cl. ..... 451/6; 451/285

(58) Field of Search ..... 451/1, 5, 8, 6, 451/7, 41, 285–289; 438/692, 691, 693; 156/345; 356/375

(56) References Cited

U.S. PATENT DOCUMENTS

| | | | | | |
|---|---|---|---|---|---|
| 5,196,353 | A | * | 3/1993 | Sandhu et al. | 216/38 |
| 5,240,552 | A | * | 8/1993 | Yu et al. | 438/14 |
| 5,308,438 | A | * | 5/1994 | Cote et al. | 216/86 |
| 5,337,015 | A | * | 8/1994 | Lustig et al. | 156/345 |
| 5,483,568 | A | * | 1/1996 | Yano et al. | 378/44 |
| 5,667,424 | A | * | 9/1997 | Pan | 451/285 |
| 5,685,766 | A | | 11/1997 | Mattingly et al. | 451/36 |
| 5,705,435 | A | | 1/1998 | Chen | 438/8 |
| 5,708,506 | A | * | 1/1998 | Birang | 451/6 |
| 5,722,875 | A | | 3/1998 | Iwashita et al. | 451/8 |
| 5,823,853 | A | * | 10/1998 | Bartels et al. | 451/5 |
| 5,949,927 | A | | 9/1999 | Tang | 385/12 |
| 6,004,187 | A | * | 12/1999 | Nyui et al. | 451/285 |
| 6,010,538 | A | | 1/2000 | Sun et al. | 756/345 |
| 6,015,333 | A | | 1/2000 | Obeng | 451/8 |
| 6,045,434 | A | * | 4/2000 | Fisher et al. | 451/10 |
| 6,066,564 | A | | 5/2000 | Li et al. | 438/692 |
| 6,071,177 | A | * | 6/2000 | Lin et al. | 156/345 |
| 6,075,606 | A | | 6/2000 | Doan | 356/381 |
| 6,108,092 | A | * | 8/2000 | Sandhu | 356/625 |
| 6,146,248 | A | * | 11/2000 | Jairath et al. | 451/10 |
| 6,179,688 | B1 | * | 1/2001 | Beckage et al. | 451/10 |
| 6,336,841 | B1 | * | 1/2002 | Chang | 451/10 |
| 6,342,166 | B1 | * | 1/2002 | Ide et al. | 216/22 |
| 6,354,908 | B2 | * | 3/2002 | Allman et al. | 451/41 |

* cited by examiner

*Primary Examiner*—Joseph J. Hail, III
*Assistant Examiner*—Anthony Ojini
(74) *Attorney, Agent, or Firm*—George O. Saile; Stephen B. Ackerman

(57) ABSTRACT

A new method is provided for endpoint detection of the polishing of a copper surface. The amount of copper dioxide that is removed from the surface that is being polished is monitored by means of a laser beam that is reflected off the polishing pad that is used for the polishing operation. The reflected light beam is analyzed for color content, based on this analysis it can be determined at what time no more copper dioxide is present on the surface of the polishing pad, which is the time that the process of removing copper from the surface that is being polished is complete. The polishing process is stopped at that time.

32 Claims, 2 Drawing Sheets

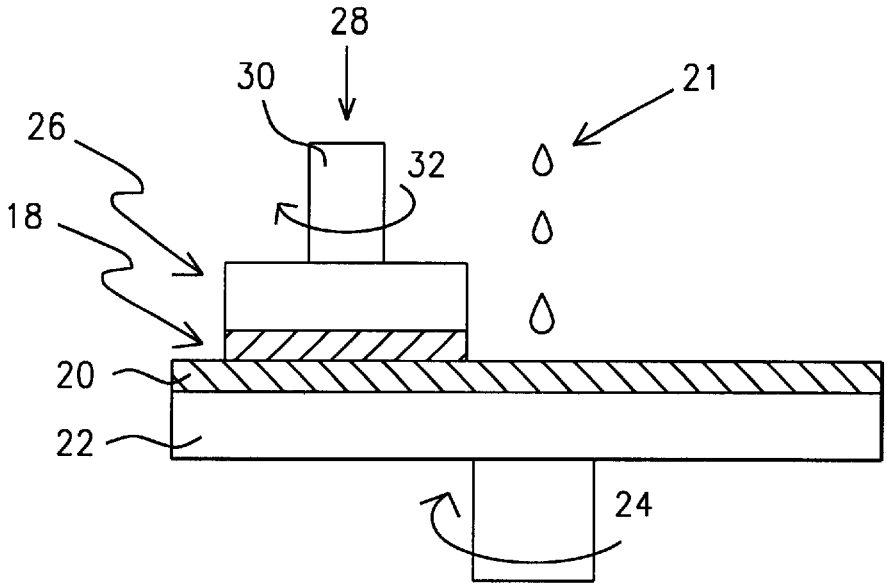
FIG. 1 – Prior Art
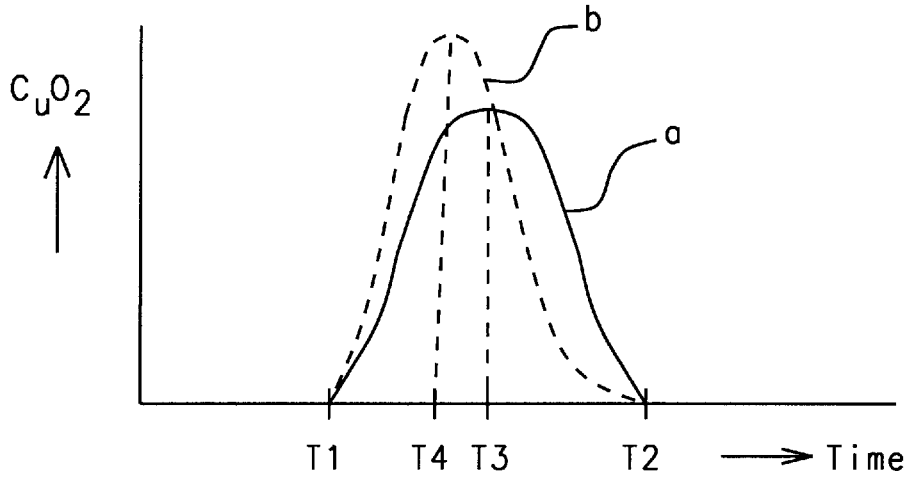
FIG. 2

METHOD FOR A COPPER CMP ENDPOINT DETECTION SYSTEM

BACKGROUND OF THE INVENTION (1) Field of the Invention

The invention relates to the fabrication of integrated circuit devices, and more particularly, to a method of determining when the endpoint of a copper Chemical Mechanical Polishing process has been reached.

(2) Description of the Prior Art

One major aspect of creating semiconductor devices is the aspect of creating surfaces of near ideal planarity or flatness. This requires polishing of semiconductor surfaces with the objective of removing unwanted particles from the surface.

It is well known in the art that forming semiconductor devices requires a large number of complex interrelated processing steps to form particular device features, these processing steps typically use and depend on a flat surface. The creation of semiconductor devices further frequently requires the creation of these devices in a number of overlaying layers of material, which further complicates the required processing steps since planarity must be maintained from layer to layer within the device structure. Good surface planarity is critically important to lithography processes since these processes depend on maintaining depth of focus. Two common techniques used to achieve planarity on a semiconductor surface are a Spin-On-Glass (SOG) etchback process and a Chemical Mechanical Polishing (CMP) process. Although both processes improve planarity on the surface of a semiconductor wafer, CMP has been shown to have a higher level of success in improving global planarity.

Chemical Mechanical Polishing (CMP) is a method of polishing materials, such as semiconductor substrates, to a high degree of planarity and uniformity. A typical CMP process involves the use of a polishing pad made from a synthetic fabric and a polishing slurry, which includes pH-balanced chemicals, such as sodium hydroxide, and silicon dioxide particles. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials, is maintained on the surface of the polishing pad to modify the polishing characteristics of the polishing pad in order to enhance the polishing of the substrate.

The motion of the wafer relative to the polishing pad creates abrasive action. The pH of the polishing slurry controls the chemical reactions, e.g. the oxidation of the chemicals which comprise an insulating layer of the wafer, while the size of the silicon dioxide particles controls the physical abrasion of the surface of the wafer. The polishing of the wafer is accomplished when the silicon dioxide particles abrade away the oxidized chemicals. An important parameter during the polishing operation is the polishing efficiency, which is the amount of material that is removed from the surface of the substrate by the CMP process as a function of time. This efficiency is, among others, dependent on the density of the pattern or the concentration of the raised areas on the surface that is being polished.

During the CMP process, the allocated polishing time and the downforce exerted on a wafer that is being polished are typically fixed and independent of the topography of the surface that is being polished. The removal rate of material from a wafer has been shown to be directly proportional to the downward force exerted on the surface that is being polished and inversely proportional to the surface area that comes into contact with the polishing pad. The removal rate of material therefore increases as the size of the polished surface decreases, and visa versa. Since different integrated circuits have different surface topographies, the material removed during a CMP process may vary from substrate to substrate and between various layers within a device structure.

Because dimensions of Integrated Circuit (IC) devices in advanced IC's continue to decrease, the dimensions of conductors and interconnection elements, which connect and interconnect those integrated circuit devices, also continue to decrease. Dimensions of conductor and interconnection elements, which directly contact IC devices, have typically decreased the greatest, thus becoming the smallest in dimension of conductor and interconnecting elements in advanced IC's. These narrow conductors and interconnections typically comprise the first conductor or interconnection level, which contacts an integrated circuit device. First conductor levels have traditionally been formed from aluminum metal or aluminum metal alloys. First interconnection levels (i.e. first conductive contact studs) are typically formed using tungsten. Conducting lines in the era of micron and sub-micron device features must have a high level of conductivity while simultaneously showing limited susceptibility to degradative phenomenon such as electromigration, a requirement that grows in importance as wire widths decrease. Electromigration may, under extremely high current densities, result in an electrical open and is most common in aluminum metal and aluminum metal alloy conductor and interconnect elements and has not typically been observed in interconnects made of tungsten. Although copper and copper alloys possess the high electrical conductivity and low electromigration susceptibility desired for conductor elements and interconnection elements within advanced IC's, methods through which copper and copper metal alloys may be formed into conductor and interconnection elements within advanced IC's are neither well developed nor well understood.

Thus, in this regard, aluminum, which has been the material of choice since the integrated circuit art began, is becoming less attractive than other better conductors such as copper, gold, and silver. Copper does provide the advantages of improved conductivity and reliability, but does as yet provide a challenge where a layer of copper must be etched using conventional methods of photolithography and reactive ion etching (RIE). This is due to the fact that copper does not readily form volatile species during the process of RIE. To circumvent these problems, other methods of creating interconnect lines using copper have been proposed such as depositing the copper patterns using methods of Chemical Vapor Deposition (CVD) or selective electroless plating. The composition of the deposited layer of metal, if the preferred element contained in the layer of metal is copper, can be changed by the addition of other metallic substances in order to improve deposition results. Copper has only recently gained more attention as an interconnect metal. Copper is known for its relatively low cost and low resistivity, copper however also has a relatively large diffusion coefficient into surrounding dielectrics such as silicon dioxide and silicon. Copper has the additional disadvantage of being readily oxidized at relatively low temperatures, therefore conventional photoresist processing cannot be used because the photoresist needs to be removed at the end of the process by heating it in a highly oxidized environment. Copper from an electrical interconnect may diffuse into a surrounding layer of dielectric (such as a layer of silicon dioxide), causing the dielectric to become conductive while at the same time decreasing the dielectric strength of the silicon dioxide layer. Copper interconnects are therefore typically encapsulated by at least one diffusion barrier layer in order to prevent diffusion into the surrounding silicon dioxide layer. Silicon nitride can serve as a diffusion barrier to copper, but prior art teaches that the interconnects should not lie on a silicon nitride layer because it has a high dielectric constant compared with silicon dioxide. The high dielectric constant causes an undesired increase in capacitance between the interconnect and the substrate. Copper further has low adhesive strength to various insulating layers, and it is inherently difficult to mask and etch a blanket copper layer into intricate circuit structures. Copper is also more resistant than aluminum to electromigration, a quality that grows in importance as wire width decreases.

In a typical CMP process, material is removed from the surface of a microelectronic substrate, the wafer is pressed against a planarizing medium (a polishing pad), an abrasive planarizing fluid or slurry is distributed over the surface that is being polished. The process of polishing or planarization is performed under controlled conditions of chemical environment (abrasive action of the slurry, controlled by the size and abrasive characteristics of the abrasive particles contained in the slurry providing etch and/or oxidation of the surface that is being polished), relative rotational velocity of polishing pad with respect to the (rotating) surface that is being polished, pressure applied to the polishing pad at the time of contact with the surface that is being polished, and temperature of the polishing media.

FIG. 1 shows a Prior Art CMP apparatus. A polishing pad 20 is attached to a circular polishing table 22 which rotates in a direction indicated by arrow 24 at a rate in the order of 1 to 100 RPM. A wafer carrier 26 is used to hold wafer 18 face down against the polishing pad 20. The wafer 18 is held in place by applying a vacuum to the backside of the wafer (not shown). The wafer carrier 26 also rotates as indicated by arrow 32, usually in the same direction as the polishing table 22, at a rate on the order of 1 to 100 RPM. Due to the rotation of the polishing table 22, the wafer traverses a circular polishing path over the polishing pad 20. A force 28 is also applied in the downward vertical direction against wafer 18 and presses the wafer 18 against the polishing pad 20 as it is being polished. The force 28 is typically in the order of 0 to 15 pounds per square inch and is applied by means of a shaft 30 that is attached to the back of wafer carrier 26. Slurry 21 is provided to the top of the polishing pad 20 to further enhance the polishing action of polishing pad 20.

Critical to the polishing operation is to remove, in a cost effective manner, the excess material from the surface that is being polished while maintaining or creating ideal planarity of this surface. While many of the parameters that control the polishing process are aimed at increasing the rate at which excess particles are removed from the surface, equally important is it to have and employ methods that control the end of the polishing process. Under-polishing results in unwanted material remaining in place on the polished surface, creating problems of planarity or problems of functionality or reliability of the devices that are being created. Over-polishing can have equally severe impact on the surface that is being polished and with that on the device that is being created. Conventional methods of controlling the period during which the polishing process is applied depend on estimating the time required to achieve the expected results. This method has serious problems of the accuracy of the estimates, a fact that can readily be appreciated with the realization of the numerous parameters that impact a polishing process such as slurry effectiveness (abrasive action and the thereon dependent particle removal rate), environmental temperature, hardness and condition of the surface that is being polished at the time of initiation of the polishing action, pattern density on or status of the surface that is being polished, precise control of applied pressure and relative rotational speeds of the rotating surfaces, status and wear of the polishing pad, and the like. For these and other reasons, it is desirable to have a method that monitors actual conditions that exist on the surface that is being polished and that do not depend, to the maximum extent possible, on environmental impact and parameters. Another conventional method to determine polishing end point is to actually remove the wafer from the polishing apparatus and measure the thickness of the wafer at the time that the wafer is removed from the polishing apparatus. It is easy to grasp that this method is extremely intrusive on a manufacturing process in addition to being time consuming and of debatable accuracy (when is the real end point reached, how often does this process need to be repeated and at what intervals, what if the end point is almost reached, etc.). Yet another method intermittently measures exposed surfaces of the wafer and follows the progress of surface removal in this manner. This method too is cumbersome and open to numerous ways of measuring erroneous data that are, in addition, difficult to correlate with operational parameters or with actual conditions as they exist on non-observed portions of the surface that is being polished.

For all of these factors, it is required to provide a method of CMP end point detection that is not time consuming, simple, dependable (repeatable) and non-intrusive. Above all, the method must be cost effective if the method is to be applied to a significant extent in today's highly competitive semiconductor manufacturing environment.

U.S. Pat. No. 5,949,927 (Tang) shows a CMP endpoint process where the laser reflects off the wafer, not the pad, and measures slurry chemical content.

U.S. Pat. No. 5,722,875 (Iwahita et al.) shows a CMP endpoint for Cu using the temperature of the pad.

U.S. Pat. No. 5,483,568 (Yano et al.) measure CMP endpoint by density of slurry particles in the slurry.

U.S. Pat. No. 6,015,333 (Obeng) shows CMP endpoint method by measuring the luminescence in the waste slurry.

U.S. Pat. No. 6,066,564 (Li et al.) shows an endpoint process by measuring the byproduct of a CMP.

U.S. Pat. No. 5,705,435 Chen), U.S. Pat. No. 6,075,606 (Doan), and U.S. Pat. No. 5,685,766 (Mattingly et al.) teach other CMP endpoint processes.

SUMMARY OF THE INVENTION

A principle objective of the invention is to provide a method to accurately measure the status of a copper Chemical Mechanical Polishing operation.

Another objective of the invention is to provide a method for copper CMP that does not depend on or require an observation window to monitor polishing status, reducing the cost of the polishing operation.

Yet another objective of the invention is to provide a method that monitors the polishing of a copper surface and that provides a continuous indication of the status of the polishing action.

A still further objective of the invention is to provide a method of monitoring the polishing of a copper surface that is independent of the characteristics or nature of the surface that is being polished, such as density of pattern and density of the copper on the surface that is being polished.

In accordance with the objectives of the invention a new method is provided for endpoint detection of the polishing of a copper surface. The amount of copper dioxide that is removed from a surface that is being polished is monitored by means of a laser beam that is reflected off the polishing pad that is used for the polishing operation. The reflected light beam is analyzed for color content, based on this analysis it can be determined at what time no more copper dioxide is present on the surface of the polishing pad. This is the time that the process of removing copper from the surface that is being polished is complete and the polishing process can be terminated.

BRIEF DESCRIPTION OF THE DRAWINGS

FIG. 1 shows a cross section of a simplified Prior Art method of polishing a semiconductor surface.

FIG. 2 shows a graph of copper dioxide concentration on the surface of a polishing pad prior to and during the process of polishing a copper surface.

DESCRIPTION OF THE PREFERRED EMBODIMENTS

Figure 3:
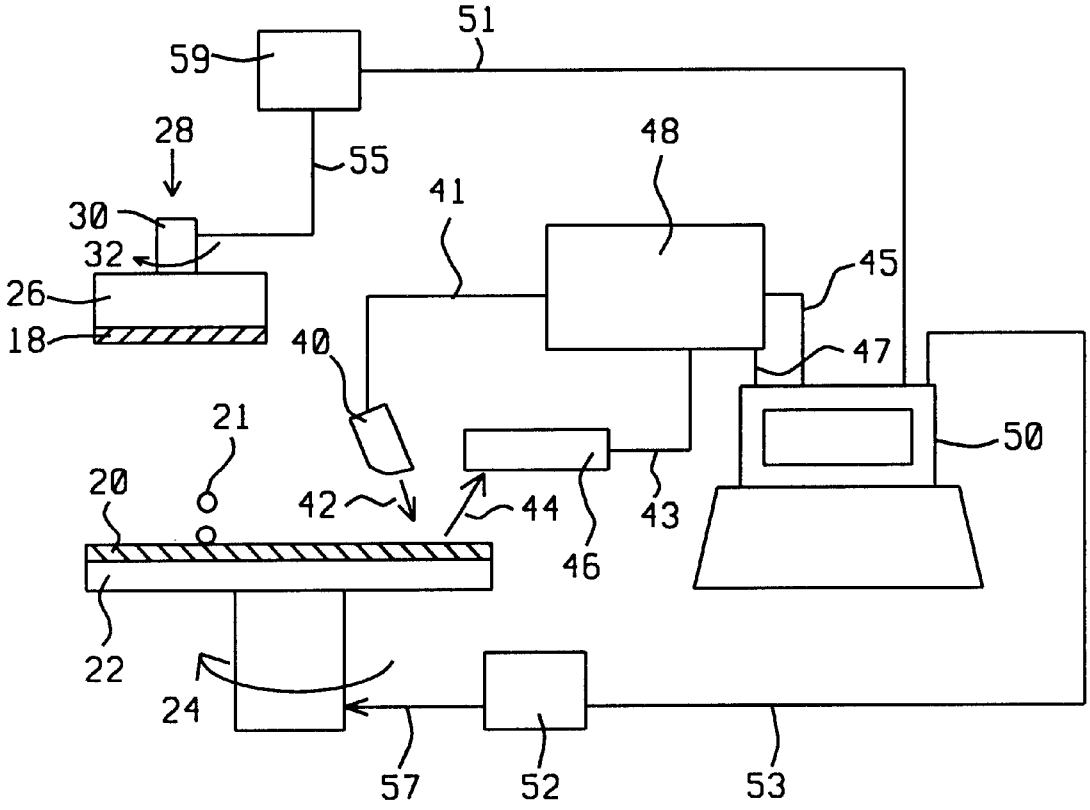
FIG. 3 shows a schematic overview of the system configuration of the invention that is used to monitor progress during the polishing of a copper surface.

Referring now specifically to FIG. 2, there is shown a graph of the concentration of copper dioxide ($CuO_2$) on the surface of a polishing pad that is used for the polishing of a copper surface. It must be remembered that copper readily oxidizes when exposed to the environment, from this it follows that the layer of copper that is being polished has concentrations of $CuO_2$ on the surface. The polishing action of the polishing pad will remove these concentrations of $CuO_2$ from the copper surface that is being polished. From this it follows that the polishing pad will contain $CuO_2$ as soon as the process of polishing the copper surface is started and will continue to have $CuO_2$ present in its surface up to the time that all the copper has been removed from the polished surface. It is thereby assumed that the oxidation of the surface of the layer of copper has penetrated through the layer of copper and to at least the surface of the layer of dielectric over which the layer of copper is deposited. The copper that is being polished is typically a layer of copper that has been deposited into a pattern of for instance trenches or via openings, these trenches or via openings have been created in a layer of intra-level dielectric. The deposited copper fills the openings (trenches or vias) and is in addition deposited over the surface of the layer of dielectric. The objective of the polishing process is to remove the copper that is deposited on the surface of the dielectric (excess copper) and, in so doing, creating conductive interconnect lines or vias of good planarity that are filled with copper. It is therefore reasonable to assume that the amount of copper that needs to be removed from the surface of the layer of dielectric is a thin layer of copper or copper deposits that are readily exposed to air and that therefore readily oxidize throughout the deposited excess copper. It is therefore further reasonable to suggest that copper dioxide is present in the copper that must be removed from the surface of the layer of dielectric.

The two graphs, curve "a" and curve "b" are examples of the rate under which copper, and with it copper dioxide, is removed from the surface of a layer of dielectric. The horizontal or X-axis shows the time before, during and after the process of polishing of a copper surface. The vertical of Y-axis indicates the concentration of copper dioxide on the surface of the polishing pad that is used for the polishing process.

There is no reason to believe that an actual process of polishing a copper surface will provide the precise results that are shown in FIG. 2. The curves that are shown in FIG. 2 serve merely as examples of a process that does however have a number of pervasive characteristics. These characteristics are that:

- before the process of polishing the copper surface is started, there is no copper dioxide present on the surface of the polishing pad; this is the time equal to or less than time T1 of FIG. 2
- after the copper has been removed from the surface that is being polished, no more copper dioxide will be present on the surface of the polishing pad; this is the time equal to or larger than time T2 of FIG. 2
- for instances in time between values T1 and T2, a certain amount of copper dioxide will be present on the surface of the polishing pad that is used for the polishing of a copper surface.

Curve "a" shows a distribution of copper removal that is symmetrical around a central value, that is the value of copper dioxide removal that is obtained at time T3. Curve "b" shows a curve where, during the initial phase of the polishing of the copper surface, the majority of copper is removed from the surface. The removal rate of curve "b" decreases after a maximum has been reached at point in time T4. It has already been stated that the particular shape of the curves that are shown in FIG. 2 (curves that can be referred to as providing copper removal profiles) is not important. What is important is that there is a starting point in time (T1, the time at which the copper oxide content on the surface of the polishing pad begins to rise, which is the time that the polishing action is started) and an end point (T2, the time at which the copper oxide is no longer present on the surface of the polishing, which is the time that the polishing action is completed).

The method of the invention of measuring the presence of copper dioxide on the surface of the polishing pad that is used for the polishing of a copper surface assumes that the slurry (and the therein contained copper dioxide) is removed from the surface of the polishing pad at an aggressive rate so that no copper dioxide remains on the surface of the polishing pad after the copper (and with it the copper dioxide) has been removed from the surface that is being polished. Any deviation from this assumption would obscure the cut-off point T2 and would therefore make the invention less accurate for monitoring the completion of the copper polishing process.

The method of measuring copper dioxide concentration of the surface of the polishing pad uses a laser beam that is aimed at the surface of the polishing pad, this laser beam will be partially absorbed and partially reflected by the surface of the polishing pad. The reflected laser beam is intercepted and analyzed for energy content as a function of the frequency of energy that is contained in the reflected laser beam. This analysis yields a (reflected laser beam) profile. The profile is indicative of the reflection that occurred by and on the surface of the polishing pad, this reflection in turn is indicative of (the make-up, content, chemical composition, presence or absence of copper dioxide) the reflecting surface. From the analysis of the reflected laser beam, a beam that is reflected by the surface of the polishing pad that is used for the polishing process, the copper dioxide concentration on the surface of the polishing pad can be determined and, with that and in accordance with the curves that are shown in FIG. 2, the status of the polishing process.

FIG. 3 provides an overview of the system that performs the analysis and processing of the reflected laser beam. The components that have previously been highlighted and that are shown in FIG. 3 are:

20, the polishing pad that is used for the polishing of a copper surface

21, the slurry that is distributed over the surface of the polishing pad,

22, the polishing platen on which the polishing pad 20 is mounted,

24, the rotational direction of the polishing platen 22,

26, a wafer carrier, also referred to as a workpiece carrier, is used to hold wafer 18 face down against the polishing pad 20

32, the wafer carrier 26 rotates as indicated by arrow 32, the wafer carrier 26 is therefore further referred to as a rotatable workpiece carrier, and

28, a force 28 is also applied in the downward vertical direction against wafer 18 and presses the wafer 18 against the polishing pad 20 as it is being polished.

Further shown in FIG. 3 are the following system components:

40, the source of the laser beam,

42, the laser beam that is emitted by the laser beam source 40 and that is directed at the surface of the polishing pad 20,

44, the laser beam that is reflected by the surface of the polishing pad 20,

46, the receiver of the reflected laser beam; this receiver may perform some filtering and other processing functions to prepare the reflected laser beam 44 for further analysis,

48, the systems component that monitors and controls (synchronizes) the laser source 40 and the laser receiver 46, effectively controlling the interaction between the transmitted beam 42 and the reflected beam 44; signal controller 48 further analyses the frequency content of the reflected laser beam 44, providing the critical feedback that is directly indicative of the level of copper dioxide that is present on the surface of polishing pad 20,

50, the computer system that performs further data analysis and manipulation,

41 is the interface between laser beam source 40 and the signal controller 48,

43 is the interface between reflected laser beam receiver 44 and the signal controller 48,

45 is the interface between the signal controller 48 and the computer 50,

47 is the feedback loop interface between the computer 50 and the signal controller 48,

59, a first rotary motor that provides rotational movement 32 to wafer carrier 26,

51, an interface between computer system 50 and the first rotary motor 59,

55, an interface between the first rotary motor 59 and the wafer carrier 26,

52, a second rotary motor that provides rotational movement 24 to polishing pad 20,

53, an interface between computer system 50 and the first rotary motor 59, and

57, an interface between the second rotary motor 52 and the polishing platen 22.

From the above highlighted components, the following functional aspects of the method and apparatus of the invention can be derived:

1) 46, the receiver of the reflected laser beam, the signal controller 48, in combination with the computer 50 and the therewith provided functional interfaces 41, 43, 45, 47, provide the means for converting the reflected light beam 44 into a measurement of the concentration of copper oxide on the surface of the polishing pad 20, this by means of an performing an analysis of the reflected laser beam 44

2) the computer system 50 provides, via interfaces 53 and 57, the means for terminating polishing of the surface of wafer 18, since computer system 50 is designed and programmed for controlling the second rotary motor 52; this terminating polishing of the surface of wafer 18 can be invoked under any of the conditions that have been highlighted in the specification, such as reaching a level of copper dioxide in removed slurry or over the surface of the wafer 18 that is being polished 3) since the wafer carrier 26 supports the wafer 18 that is being polished, the wafer 18 can also be referred to as a workpiece (a piece that is being polished or "worked"), the wafer carrier therefore can be referred to as a rotatable workpiece carrier, and 4) 18, the rotating semiconductor wafer.

The sequence of the invention can, after the preceding descriptions, be summarized as follows:

the polishing apparatus that is used for the polishing of a semiconductor surface, such as the surface of a dielectric or the surface of a substrate, is prepared for the polishing process, including the mounting of the polishing pad 20, the mounting of the semiconductor substrate (not shown in FIG. 3), the preparation of the slurry flow (not shown in FIG. 3), the positioning of the polishing pad 20 with respect to the surface that is to be polished, the laser beam source 40 is positioned such that the therefrom emitted laser beam 42 strikes the surface of the polishing pad 20 under an angle, the laser beam receiver 46 is positioned such that laser beam 44 that is reflected by the surface of the polishing pad 20 is intercepted by the laser beam receiver 46, connections (41, 43, 45 and 47) between the various systems components have been established and verified, the laser beam source (40), laser beam receiver (46), signal controller (48) and computer (50) are calibrated and activated, the polishing process is initiated, and the polishing process is monitored using the copper dioxide monitoring system of the invention that has been described above.

The invention, providing a method and apparatus for end-point detection during abrasive polishing of the surface of a semiconductor wafer, can be summarized as follows:

slurry including a liquid having a suspension of abrasive particles being sprayed upon a surface of a rotating polishing pad a rotating semiconductor substrate having a deposition of copper on the surface thereof being brought into contact with a surface of the polishing pad, the polishing pad being exposed during contact directing a laser beam onto the exposed surface of the polishing pad detecting a reflected laser beam, said reflected laser beam being created due to the laser beam being directed at the exposed surface of the polishing pad converting the detected laser beam into a measurement of a concentration of copper dioxide on the surface of the polishing pad, the conversion being enabled by an equation, the equation providing a relationship between the reflected laser beam and the concentration of copper on the surface of the polishing pad the laser beam that is directed onto the exposed surface of the polishing pad stimulates reflection by the surface of the polishing pad such that the reflection is detected the abrasive polishing is Chemical Mechanical Polishing the converting step includes utilizing a predetermined functional relationship between the reflected laser beam and concentration of copper dioxide on the surface of the polishing pad the converting step includes utilizing a predetermined functional relationship between the concentration of removed material from the wafer in the slurry and the reflected laser beam removed material is copper dioxide, and the converting step includes utilizing a predetermined functional relationship between the concentration of removed material in the slurry and the reflected laser beam.

It is clear that a direct interconnection can be established between the signal controller/computer of the invention and the mechanism that initiates the polishing process. This link provides the needed signals that control the polishing process, most important among these signals are start and stop time. It is envisioned that the start time will essentially remain an operator initiated start time but the start time does not have to be limited to that. It is entirely conceivable that, in an automated semiconductor manufacturing environment, the step of starting the polishing process is controlled by the signal controller/computer over interfaces between the signal controller/computer and the mechanism that initiates the actual polishing action such as starting rotary motors (for the rotation of the wafer carrier and the polishing pad platen), bringing the surface that is being polished into contact with the polishing pad and initiating slurry flow. These supporting functions can readily be automated but do not form part of the invention. The invention however does provide the method whereby functions of polishing and polishing parameters (rotational speeds, pressure applied between the surface that is being polished and the polishing pad, speed of slurry flow, slurry content and temperature) can be closely correlated with the results and status that are achieved by the polishing process. The invention therefore can be readily integrated not only into a manually operated system but also in a system that is highly automated and computer controlled.

Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

What is claimed is:

1. A method for end-point detection during abrasive polishing of the surface of a semiconductor wafer, slurry including a liquid having a suspension of abrasive particles being sprayed upon a surface of a rotating polishing pad, a rotating semiconductor substrate having a deposition of copper on the surface thereof being brought into contact with a surface of the polishing pad, the polishing pad being exposed during contact, the method comprising:

directing a laser beam onto the exposed surface of the polishing pad;

detecting a reflected laser beam, said reflected laser beam being created due to the laser beam being directed at the exposed surface of the polishing pad; and converting the color content of the detected laser beam into a measurement of a concentration of copper dioxide on the surface of the polishing pad, said conversion being enabled by an equation, said equation providing a relationship between the reflected laser beam and the concentration of copper on the surface of the polishing pad.

2. The method of claim 1 wherein the laser beam that is directed onto the exposed surface of the polishing pad stimulates reflection by the surface of the polishing pad such that the reflection is detected.

3. The method of claim 1 wherein the abrasive polishing is Chemical Mechanical Polishing.

4. The method of claim 1 wherein the converting step includes utilizing a predetermined functional relationship between the reflected laser beam and concentration of copper dioxide on the surface of the polishing pad.

5. The method of claim 1 wherein the converting step includes utilizing a predetermined functional relationship between the concentration of removed material from the wafer in the slurry and the reflected laser beam.

6. The method of claim 5 wherein said removed material is copper dioxide.

7. The method of claim 1 wherein the converting step includes utilizing a predetermined functional relationship between the concentration of removed material in the slurry and the reflected laser beam.

8. The method of claim 7 wherein said removed material is copper dioxide.

9. A method for performing abrasive polishing, comprising:

rotating a polishing pad and spraying a slurry including a liquid having a suspension of abrasive particles therein onto a surface of the polishing pad;

rotating a semiconductor wafer and bringing the rotating wafer into contact with the surface of the polishing pad with an area of the surface of the polishing pad being exposed during contact;

directing a laser beam at the exposed surface area of the polishing pad;

detecting the reflected laser beam, said reflected laser beam being created due to the laser beam being directed at the polishing pad; and converting the color content of the detected laser beam into a measurement of a concentration of copper dioxide on the surface of the wafer, said conversion being enabled by an equation, said equation providing a relationship between the reflected laser beam and the concentration of copper dioxide on the surface of the wafer.

10. The method of claim 9, the directing a laser beam comprising a laser beam that stimulates reflection of the laser beam from the surface of the wafer such that the reflected laser beam is detected.

11. The method of claim 9 wherein the abrasive polishing is Chemical Mechanical Polishing.

12. The method of claim 9 wherein the abrasive polishing comprises polishing a surface that comprises copper.

13. The method of claim 9 wherein the converting step includes utilizing a predetermined functional relationship between the reflected laser beam and concentration of copper dioxide on the surface of the polishing pad.

14. The method of claim 9 wherein the converting step includes utilizing a predetermined functional relationship between the concentration of removed material from the wafer in the slurry and the reflected laser beam.

15. The method of claim 14 wherein said removed material is copper dioxide.

16. The method of claim 9 wherein the converting step includes utilizing a predetermined functional relationship between the concentration of removed material in the slurry and the reflected laser beam.

17. The method of claim 16 wherein said removed material is copper dioxide.

18. A method for performing abrasive Chemical Mechanical Polishing of a surface of a semiconductor wafer that comprises copper, comprising:

rotating a polishing pad and spraying a slurry including a liquid having a suspension of abrasive particles therein onto a surface of the polishing pad;

rotating a semiconductor wafer and bringing the rotating wafer into contact with the surface of the polishing pad, an area of the surface of the polishing pad being exposed during contact;

directing a laser beam at the exposed surface area of the polishing pad, stimulating reflection of the laser beam from the surface of the polishing pad;

detecting the reflected laser beam, said reflected beam being created due to the laser beam being directed at the polishing pad; and converting the color content of the detected laser beam into a measurement of a concentration of copper dioxide on the surface of the wafer, said conversion being enabled by an equation, said equation providing:

(i) a relationship between the concentration of copper dioxide on the surface of the wafer and the reflected wafer beam; and (ii) a relationship between the concentration of copper dioxide in the slurry and the reflected laser beam.

19. A method for performing abrasive Chemical Mechanical Polishing of a surface of a semiconductor wafer that comprises copper, comprising:

rotating a polishing pad and spraying a slurry including a liquid having a suspension of abrasive particles therein onto a surface of the polishing pad;

rotating a semiconductor wafer and bringing the rotating wafer into contact with the surface of the polishing pad, the polishing pad being exposed during contact;

directing a laser beam at the exposed surface area of the polishing pad, stimulating reflection of the laser beam from the surface of the polishing pad;

detecting the reflected laser beam, said reflected laser beam being created due to the laser beam being directed at the polishing pad;

converting the color content of the detected laser beam into a measurement of concentration of copper dioxide on the surface of the wafer; and terminating polishing after a concentration of copper dioxide on the surface of the wafer has reached a first level after which the concentration of copper on the surface of the wafer undergoes a reduction to a second level, said second level being less than said first level by a measurable amount.

20. A semiconductor workpiece processing apparatus for Chemical Mechanical Polishing of a copper comprising surface, comprising:

a rotatable workpiece carrier, the rotating motion of the carrier being imparted to a workpiece positioned thereon;

a rotatable polishing pad having an upper surface, said workpiece carrier and said polishing pad being relatively movable, allowing the workpiece being brought into contact with the polishing pad, the polishing pad having a larger surface than the workpiece, leaving the polishing pad exposed when the workpiece is in contact with the polishing pad;

a slurry dispenser disposed to dispense slurry on the upper surface of the polishing pad;

a source of laser beam, said source of laser beam being positioned to direct a laser beam at the exposed surface area of the polishing pad, resulting in a laser beam being reflected from the surface of the polishing pad;

a laser beam receiver, said laser beam receiver being positioned to receive the reflected beam; and means for converting the color content of the reflected laser beam into a measurement of a concentration of copper oxide on the surface of the pad.

21. An apparatus for performing abrasive polishing, comprising:

a rotating polishing pad over the surface of which is sprayed a slurry including a liquid having a suspension of abrasive particles therein;

a rotating semiconductor wafer brought into contact with the surface of the polishing pad, the polishing pad being exposed during contact;

a laser beam directed at the exposed surface area of the polishing pad, resulting in creating a reflected laser beam;

means for detecting the reflected laser beam, said reflected laser beam being created due to the laser beam being directed at the polishing pad; and means to convert the color content of the detected laser beam into a measurement of a concentration of copper dioxide on the surface of the wafer, said measurement being enabled by an equation, said equation providing a relationship between the reflected laser beam and the concentration of copper dioxide on the surface of the wafer.

22. The apparatus of claim 21, the directing a laser beam comprising a laser beam that stimulates reflection of the laser beam from the surface of the wafer such that the reflected laser beam is detected.

23. The apparatus of claim 21, the abrasive polishing is Chemical Mechanical Polishing.

24. The apparatus of claim 21 wherein the abrasive polishing comprises polishing a surface that comprises copper.

25. The apparatus of claim 21 wherein the converting step includes utilizing a predetermined functional relationship between the reflected laser beam and concentration of copper dioxide on the surface of the polishing pad.

26. The apparatus of claim 21 wherein the converting step includes utilizing a predetermined functional relationship between the concentration of removed material from the wafer in the slurry and the reflected laser beam.

27. The apparatus of claim 26 wherein said removed material is copper dioxide.

28. The apparatus of claim 21 wherein the converting step includes utilizing a predetermined functional relationship between the concentration of removed material in the slurry and the reflected laser beam.

29. The apparatus of claim 28 wherein said removed material is copper dioxide.

30. An apparatus for performing abrasive Chemical Mechanical Polishing of a surface of a semiconductor wafer that comprises copper, comprising:

a rotating polishing pad and sprayed slurry, said slurry comprising a liquid having a suspension of abrasive particles therein, said slurry being sprayed over a surface of the polishing pad;

a semiconductor rotating wafer brought into contact with the surface of the polishing pad with the polishing pad being exposed during contact;

a laser beam directed at the exposed surface area of the polishing pad, stimulating reflection of the laser beam from the surface of the polishing pad;

a detected reflected laser beam, said reflected laser beam being created due to the laser beam being directed at the polishing pad; and means for converting the color content of the detected laser beam into a measurement of a concentration of copper dioxide on the surface of the wafer by;

(i) utilizing a relationship between the reflected laser beam and the concentration of copper dioxide on the surface of the wafer; or functional relationship between the concentration of copper dioxide from the wafer in the slurry and the reflected laser beam; and (ii) by utilizing a relationship between the concentration of copper dioxide in the slurry and the reflected laser beam.

31. An apparatus for performing abrasive Chemical Mechanical Polishing of a surface of a semiconductor wafer that comprises copper, comprising:

a rotating polishing pad and sprayed slurry, said slurry comprising a liquid having a suspension of abrasive particles therein, said slurry being sprayed over a surface of the polishing pad;

a rotating semiconductor wafer, said wafer being brought into contact with the surface of the polishing pad, a surface of the polishing pad being exposed during contact;

a laser beam directed at the exposed surface area of the polishing pad, stimulating reflection of the laser beam from the surface of the polishing pad;

a reflected laser beam, said reflected beam being created due to the laser beam being directed at the polishing pad;

means for converting the color content of the detected laser beam into a measurement of a concentration of copper dioxide on the surface of the wafer; and means for terminating polishing after;

(i) a concentration of copper dioxide on the surface of the wafer has first reached a first level; and then (ii) the concentration of copper on the surface of the wafer undergoes a reduction to a second level, said second level being less than said first level by a measurable amount.

32. A semiconductor workpiece processing apparatus for Chemical Mechanical Polishing of a copper comprising surface, comprising:

a rotatable workpiece carrier, the rotating motion of the carrier being imparted to a workpiece positioned thereon;

a rotatable polishing pad having an upper surface, said workpiece carrier and said polishing pad being relatively movable, allowing the workpiece being brought into contact with the polishing pad, the polishing pad having a larger surface than the workpiece, leaving the polishing pad exposed when the workpiece is in contact with the polishing pad;

a slurry dispenser disposed to dispense slurry on the upper surface of the polishing pad;

a source of a laser beam, said source of a laser beam being positioned to direct a laser beam at the exposed surface area of the polishing pad, resulting in a laser beam being reflected by the surface of the polishing pad;

a laser beam receiver, said laser beam receiver being positioned to receive the reflected laser beam; and means for converting the color content of the reflected laser beam into a measurement of a concentration of copper oxide on the surface of the polishing pad.

* * * * *